United States Patent [19]

Kondo

[11] 4,074,516

[45] Feb. 21, 1978

[54] ALARM ELECTRONIC TIMEPIECE

[75] Inventor: Kenichi Kondo, Tokyo, Japan

[73] Assignee: Kabushiki Kaisha Daini Seikosha, Japan

[21] Appl. No.: 732,029

[22] Filed: Oct. 13, 1976

[30] Foreign Application Priority Data

Oct. 13, 1975 Japan ..... 50-123006

[51] Int. Cl.[2] ..... G04C 21/00

[52] U.S. Cl. ..... 58/38 R; 58/57.5; 58/152 B

[58] Field of Search ..... 58/227, 23 R, 57, 57.5, 58/152 B, 39.5

[56] References Cited

U.S. PATENT DOCUMENTS

| | | | |
|---|---|---|---|
| 3,664,116 | 5/1972 | Emerson et al. | 58/23 R |
| 3,745,761 | 7/1973 | Tsuruishi | 58/38 |
| 3,822,547 | 7/1974 | Fujita | 58/152 B |
| 3,834,153 | 9/1974 | Yoda et al. | 58/38 |
| 3,946,549 | 3/1976 | Cake | 58/38 R |
| 3,949,240 | 4/1976 | Saito et al. | 307/141 |
| 4,005,571 | 2/1977 | Wolff | 58/39.5 |
| 4,016,562 | 4/1977 | Gerum | 340/384 E |

*Primary Examiner*—B. Dobeck
*Assistant Examiner*—Vit W. Miska
*Attorney, Agent, or Firm*—Robert E. Burns; Emmanuel J. Lobato; Bruce L. Adams

[57] ABSTRACT

An electronic timepiece is provided with a minute counter, an hour counter, a settable and resettable counter for storing an alarm time and a circuit for detecting the concidence between the stored alarm time and the contents of the minute and hour counters for developing a coinciding signal in response thereto and an alarm is produced in response to the coinciding signal. A first switch is switchable between a first and second state and a circuit is responsive to the coinciding signal for resetting the alarm time counter when the switch is in the first state and for maintaining the alarm counter in the set state when the switch is in the second state, whereby the timepiece can be selectively used in single alarm and repeat alarm modes.

7 Claims, 2 Drawing Figures

ALARM ELECTRONIC TIMEPIECE

BACKGROUND OF THE INVENTION

This invention relates to an alarm electronic timepiece having alarm means composed of a single alarm for generating an alarm signal without a repeat operation and a repeat alarm for repeatedly generating an alarm signal when a preset time has come and all controlled by one set time memory circuit.

In the conventional type, the electronic timepiece usually generates the alarm signal when the preset time has come or generates the single alarm signal, whereby it was impossible to set a preferable setting operation, and thus the operation of the watch was complicated. Further it was necessary to separately prepare the memory circuit for the single alarm and another memory circuit for the repeat alarm as different channels, whereby a circuit was complicated.

SUMMARY OF THE INVENTION

The present invention aims to eliminate the above noted difficulty and insufficiency.

DETAILED DESCRIPTION OF THE PREFERRED EMBODIMENT

Figure 1:
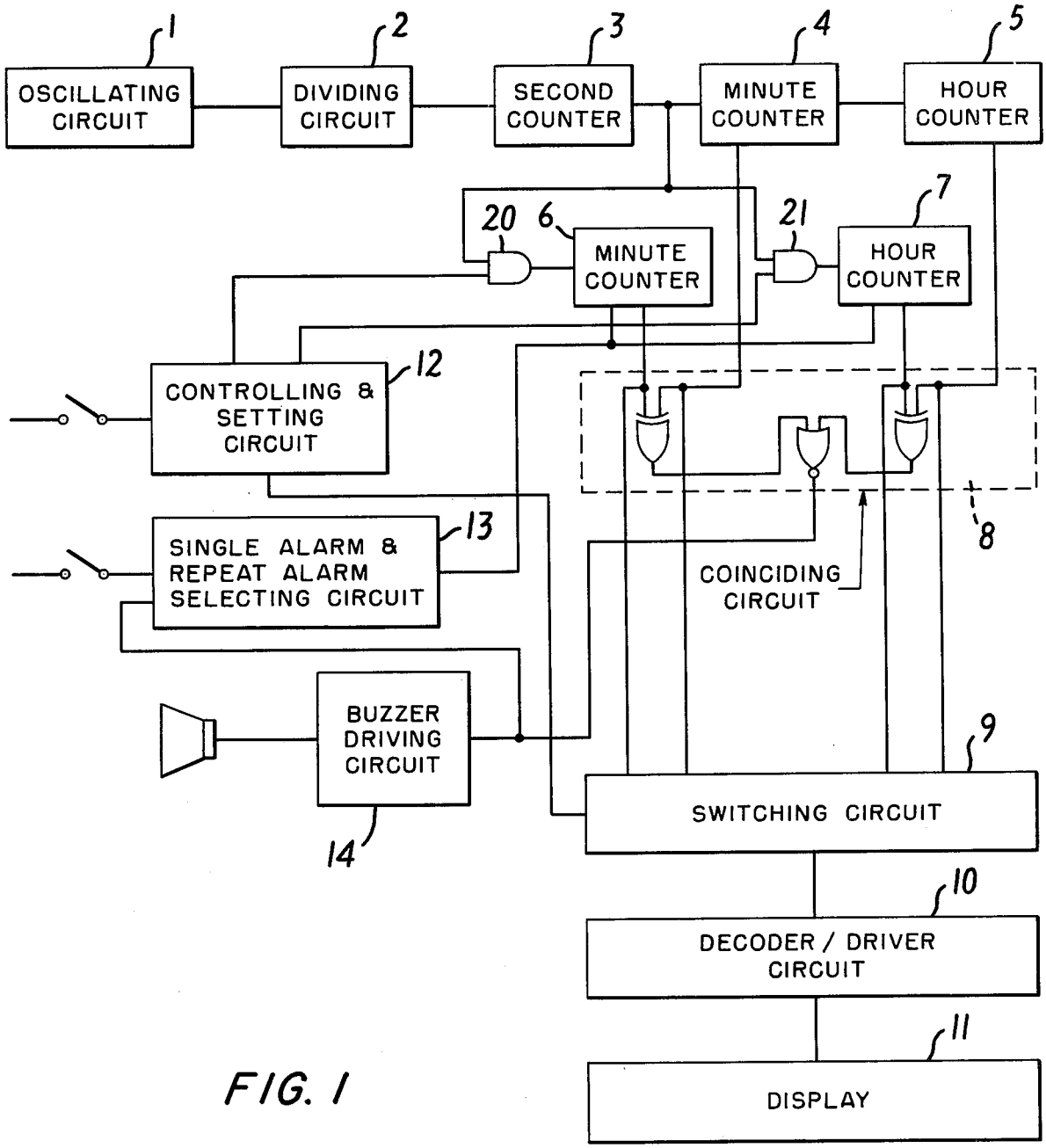
FIG. 1 shows a block diagram of one embodiment of the present invention.

FIG. 1 shows a block diagram as an embodiment as an alarm electronic timepiece of the present invention. A signal having a high frequency is generated from an oscillating circuit 1 having a quartz element and is applied to a dividing circuit 2. The 1Hz signal circuit of said dividing signal is applied to a second counter 3 and counts seconds, the output of said second counter 3 is applied to a minute counter 4 and counts minutes, the output of said minute counter 4 is applied to an hour counter 5 and counts hours.

The minute counter 6 and hour counter 7 are selected by a signal of a controlling and setting circuit 12, with a 1Hz signal applied to said minute counter 6 and hour counter 7 via AND-gates 20 and 21 whereby the setting or alarm time is set. The BCD signals of said minute counter 6 and hour counter 7 as a setting time and the BCD signals of the minute and hour counters 4 and 5 as the time counter are applied to a coinciding circuit 8, whereby the coincided signal is detected. Said coincided signal is applied to a buzzer driving circuit 14 and drives a buzzer.

On the other hand, the BCD signal of said minute counters 4 and 6 and said hour counters 5 and 7 are applied to a switching circuit 9, whereby the display of time display or setting time selected by the selecting and controlling signal of controlling and setting circuit 12, is applied to a decoder driver circuit 10, then the time display or setting time is displayed.

Figure 2:
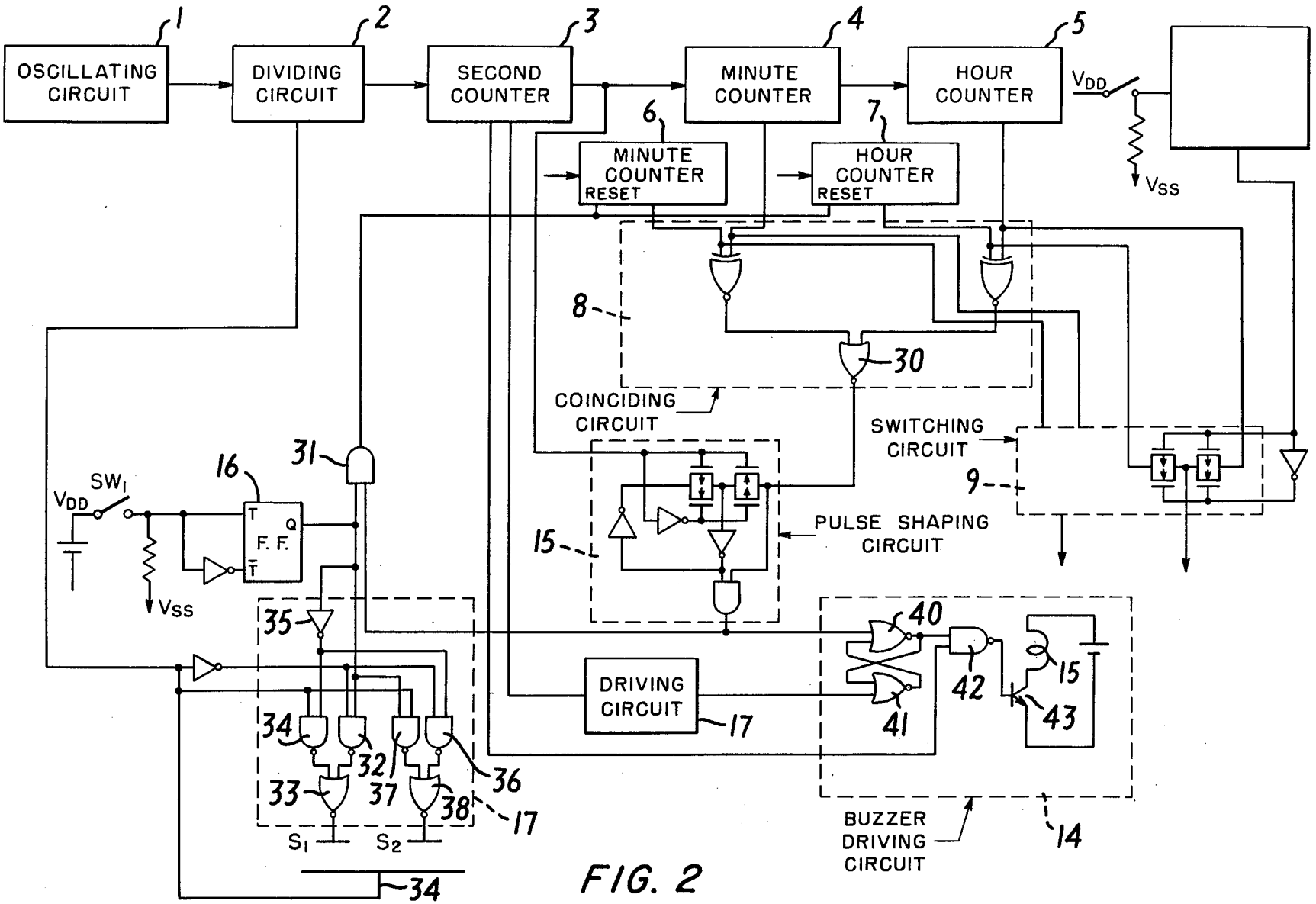
FIG. 2 shows a circuit construction of the detailed embodiment of FIG. 1.

Said coincided signal is applied to a single alarm and repeat alarm selecting circuit 13, the output signal of said circuit 13 is applied to the resetting terminal of said minute and hour counters 6 and 7 which is the memory circuit of the setting time, whereby the contents of the set time or alarm time is cleared by the Reset-signal in the case of a single alarm. FIG. 2 is the circuit for showing the detailed embodiment of the present invention.

The output of NOR-circuit 30 gases to "1" when the contents of said time counters 4 and 5 coincide with the contents of said setting time counters 6 and 7, said output of NOR-circuit 30 is shaped to a short pulse by a pulse shaping circuit 15 which is controlled by the 1Hz-signal and is composed of two transmission-gates, three inverters and an AND-circuit, whose output is connected to one input of AND-gate 31. The Q-terminal of T-type flip flop circuit 16 is applied to the other input terminal of AND-gate 31. The output condition of Q is usually able to change by a single repeat alarm selecting switch $SW_1$, the coincided signal of said pulse shaping circuit 15 is generated, whereby the contents of the setting time memory is reset, the time goes to 0 hour 00 minute and the alarm is not operated thereafter even while the output condition of Q is "1". When the coincided signal is not generated to AND-gate 31 and when the output Q is at the "0" condition, the setting time counter is not reset, then the alarm is operated when the setting time comes. The single and repeat alarm are easily selected by the operation of said single and repeat alarm selecting switch $SW_1$. The output Q of the single and alarm selecting circuit is composed of T-type flip flop 16 whose output Q is applied to a driving circuit 17 for displaying the display of single or repeat alarm.

Namely in the use of liquid crystal as the display a device, 32Hz-signal is applied to a common electrode 34 from said dividing circuit 2. The 32Hz-signal is generated to AND-gate 32 when the output Q of said T-type flip flop is "1" namely the single alarm, and the inverted signal of the signal of a common electrode 34 is generated as the output of NOR-circuit 33 whereby the display segment $S_1$ of the single alarm is displayed, further the display segment $S_2$ of the repeat alarm is not displayed according to the same phase to the signal of said common electrode 34. When the output Q of T-type flip flop circuit is at the "0" condition, the signal is inverted by the inverter 35 and is applied to AND-gate 36 whereby said repeat alarm display $S_2$ is displayed, however the voltage is the same phase as the signal of said common electrode 34 and is applied to said single alarm display $S_1$ whereby said single alarm display is not displayed. The coincided signal is applied to the flip-flop circuit NOR 40 of the buzzer driving circuit 14, and sets the output of NOR-circuit 41 to "1", and drives said buzzer 15 in response to the driving frequency of said seconds counter 3 via NAND-circuit 42 and transistor 43. The signal from said seconds counter 3 is applied to NOR-circuit 41 ten seconds later after the coincided signal, whereby NOR-circuit 41 is reset, said buzzer is stopped. According to the present invention, it is possible to voluntarily select the single alarm and repeat alarm by only one channel of the alarm electronic timepiece.

I claim:

1. In an electronic timepiece of the type having a minute counter and an hour counter: settable and resettable means for storing an alarm time therein; means for detecting a coincidence between the stored alarm time and the contents of the minute and hour counters for developing a coinciding signal in response thereto; means responsive to said coinciding signal for producing an alarm; first manual means for switching between a first state and a second state; and means responsive to said coinciding signal for resetting the means for storing when the first manual means is in the first state and for maintaining the means for storing in the set condition when the first manual means is in the second state;

whereby the timepiece can be selectively used in single alarm and repeat alarm modes.

2. In an electronic timepiece according to claim 1; wherein said means for storing comprises a minute and an hour counter and wherein said means for resetting includes a T-type flip-flap having the output th-reof connected to the reset input of the minute and hour counter.

3. In an electronic timepiece according to claim 1; further comprising second manual means for switching between a first state and a second state; an hour display, a minute display, a switching circuit receptive of the outputs of the hour and minute counters for directing same to the hour and minute displays respectively when the second manual means is in the first state and receptive of the outputs of the means for storing for directing same to the hour and minute displays when the second manual means is in the second state.

4. In an electronic timepiece according to claim 1; wherein said first manual means comprises a switch mounted to the outside of the timepiece.

5. In an electronic timepiece according to claim 1; wherein said means for developing the coinciding signal comprises a pulse shaping circuit.

6. In an electronic timepiece according to claim 1; further comprising a display having a portion thereof indicating the single alarm mode and a portion thereof indicating the repeat alarm mode and means for alternatively enabling the display of one or the other in dependence upon the state of the first manual means.

7. In an electronic timepiece according to claim 6; further comprising an oscillating circuit and wherein the means for alternatively enabling includes means in synchronism with said oscillating circuit for flashing the display of the enabled indicating portion.

* * * * *